US006955029B2

(12) United States Patent
Palumbo

(10) Patent No.: US 6,955,029 B2
(45) Date of Patent: Oct. 18, 2005

(54) APPARATUS AND METHOD FOR PACKAGING PRODUCTS

(75) Inventor: Riccardo Palumbo, Arona (IT)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 10/398,727

(22) PCT Filed: Oct. 5, 2001

(86) PCT No.: PCT/IB01/01855

§ 371 (c)(1),
(2), (4) Date: Aug. 25, 2003

(87) PCT Pub. No.: WO02/30759

PCT Pub. Date: Apr. 18, 2002

(65) Prior Publication Data

US 2004/0040262 A1 Mar. 4, 2004

(30) Foreign Application Priority Data

Oct. 12, 2000 (EP) ..... 00203556

(51) Int. Cl.[7] ..... B65B 31/02; B31B 1/00

(52) U.S. Cl. ..... 53/469; 53/168; 53/504; 53/66

(58) Field of Search ..... 53/504, 457, 467, 53/493, 468, 475, 66, 168, 469

(56) References Cited

U.S. PATENT DOCUMENTS

| | | | | |
|---|---|---|---|---|
| 2,939,259 A | | 6/1960 | Heckler | |
| 3,763,620 A | | 10/1973 | Giraudi et al. | |
| 4,241,562 A | | 12/1980 | Meyer | |
| 4,334,558 A | | 6/1982 | Durant | |
| 4,575,990 A | | 3/1986 | von Bismarck | |
| 5,743,071 A | * | 4/1998 | Wolthuizen | 53/571 |
| 5,816,990 A | | 10/1998 | Melville | |
| 5,826,411 A | | 10/1998 | Butturini | |
| 6,349,526 B1 | | 2/2002 | Newman | |
| 2003/0131567 A1 | * | 7/2003 | Timmerman et al. | |

FOREIGN PATENT DOCUMENTS

| | | | | |
|---|---|---|---|---|
| DE | 1 272 806 | | 7/1968 | |
| DE | 195 34 626 A1 | | 11/1996 | |
| EP | 870678 A1 | * | 10/1998 | B65B/9/06 |
| EP | 875455 A1 | * | 11/1998 | B65B/9/06 |

* cited by examiner

*Primary Examiner*—Rinaldi I. Rada
*Assistant Examiner*—Brian Nash
(74) *Attorney, Agent, or Firm*—Daniel B. Ruble

(57) ABSTRACT

An apparatus for packaging products having different shape and dimensions, such as for example food products of different size, into pre-formed bags of appropriate size, such as for example heat-shrinkable bags of thermoplastic material, comprises a conveyor for carrying in sequence a plurality of products to be packaged from a product loading portion to a product packaging bracket end portion thereof, means for detecting the dimensions of each product to be packaged while it moves from said product loading portion to said product packaging bracket end portion of said at least one conveyor and a plurality of bag dispensing devices for dispensing a plurality of bags varying in at least one dimension thereof. The apparatus also comprises means for automatically selecting a bag dispensing device from said plurality of bags dispensing devices, depending on the detected product dimensions, and means for picking-up a bag from the selected bag dispensing device and positioning it around the product packaging bracket end portion of said at least one conveyor thus packaging the product present thereon. A method for packaging products by means of an apparatus of the type above described is also disclosed.

29 Claims, 7 Drawing Sheets

APPARATUS AND METHOD FOR PACKAGING PRODUCTS

FIELD OF THE INVENTION

The present invention relates to an apparatus and a method for packaging products. More particularly, the invention relates to an apparatus and a method for packaging a plurality of products (such as, for example, food products) with different shape and dimensions into pre-formed bags of appropriate size (such as, for example, bags made of heat-shrinkable thermoplastic material).

In the present description and following claims, the term "pre-formed bags" is used to indicate either end-sealed or side-sealed bags provided with at least one unsealed side portion defining an openable mouth, for introducing the product to be packaged therein.

BACKGROUND OF THE INVENTION

Apparatus and methods for packaging products into pre-formed bags are well known in the art. Typically, in the simplest embodiment thereof, such an apparatus comprises a conveyor, for example a conveyor belt, for carrying the products to be packaged from a loading portion to a packaging portion thereof and a bag dispensing device housing a plurality of pre-formed bags and able to continuously provide an open bag. All the bags of said plurality of bags are housed in a single box and are substantially, identical each other. The bag dispensing device is placed in proximity of a free end of the packaging portion of the conveyor belt. In operation, each product to be packaged is loaded by the operator(s) onto the conveyor belt and moves toward the packaging portion thereof; when the product approaches the free end of the packaging portion of the conveyor belt, a pushing member (or an operator) pushes the product into the open bag. The apparatus is then ready for the packaging of a following product; in the meantime, the packaged product is delivered to following processes, such as, for example, vacuumization, sealing or clipping, heating and shrinking processes.

In other conventional apparatus, the bag dispensing device is not placed in proximity of the free end of the packaging portion of the conveyor belt, but at a different position. In operation, when the product approaches the free end of the packaging portion of the conveyor belt, the operator picks the bag up from the bag dispensing device, moves it close to the free end of the packaging portion of the conveyor belt and push the product into the bag.

Sometimes, especially for food, products, it would be desirable to package products of different dimensions and shape into pre-formed bags having appropriate size and/or shape. In particular, in some packaging processes, the bag containing the product is vacuumized, closed by sealing or clipping, and then heat-shrunk. This is aimed at increasing the shelf-life of the packaged product and/or improving the aesthetic appearance of the package. Bags of heat-shrinkable thermoplastic material are employed in these processes but, in order to avoid the formation of small blisters of packaging material filled with the drip of the packaged product (e.g. blood or grease), it is extremely important to select the heat-shrinkable bag of the suitable size.

With this regard, conventional apparatus of the type described above lack flexibility in operation, since it does not allow the packaging of products with different shape and dimensions into bags of appropriate size and/or shape within the same production batch. In fact, in the prior art apparatus above described, a plurality of bags having all the same size and shape are available within the same production batch. When a change in size and/or shape is required, the box containing the previously used bags is replaced by a new box containing the required new-sized bags. The packaging apparatus must therefore be shut-down, reset and restarted, thus decreasing the total production yield of the apparatus.

SUMMARY OF THE INVENTION

The problem at the basis of the present invention is to provide a more flexible and reliable apparatus and method for packaging products of different shape and dimensions into pre-formed bags having appropriate size and/or shape without requiring any resetting process of the apparatus itself, thus overcoming the drawbacks mentioned above with respect to the apparatus of the prior art.

Therefore, in a first aspect thereof, the present invention relates to an apparatus for, packaging products, comprising:

at least one conveyor for carrying in sequence a plurality of products to be packaged from a product loading portion to a product packaging bracket end portion thereof;

means for detecting the dimensions of each product to be packaged while the product moves from said product loading portion, to said product packaging bracket end portion of said at least one conveyor;

a plurality of bag dispensing devices for dispensing a plurality of bags varying in at least one dimension thereof;

means for selecting a bag dispensing device from said plurality of bags dispensing devices, depending on the detected product dimensions;

means for picking-up a bag from the selected bag dispensing device and positioning it around the product packaging bracket end portion of said at least one conveyor thus packaging the product present thereon.

In the present description and following claims, the term "bracket end portion" of the conveyor is used to indicate an end portion of the conveyor which has five free sides (the upper side, the lower side, the left side, the right side and the frontal side) and therefore adapted to be inserted into a bag-type structure.

Advantageously, the apparatus of the present invention allows the packaging of products with different shape and dimensions into bags having appropriate shape and/or size within the same production batch, without requiring any resetting process of the apparatus, thus increasing the overall apparatus productivity. In fact, a bag with appropriate size and/or shape is always available for packaging a predetermined product; such a bag is selected depending on the detected product dimensions.

More advantageously, according to the present invention, the packaging of the products is carried out by a totally automated process; consequently, the apparatus of the invention appears flexible and reliable. In particular, with respect to the prior art apparatus previously disclosed with respect to the prior art and requiring the intervention of the operator (s) in the packaging process, the apparatus of the invention appears more reliable because delays and malfunctions in the packaging process implied by such intervention are eliminated. Still more advantageously, particularly for food product, the contact between foodstuff and operator(s) is completely eliminated, thus drastically reducing the risks of product contamination.

In a first embodiment of the apparatus of the present invention, said plurality of bag dispensing devices are adapted to provide, for each product to be packaged, a plurality of bags of different size and each bag dispensing device of said plurality of bag dispensing devices comprises a plurality of bags having substantially all the same size and means for placing a bag of said plurality of bags at a pick-up position. According to this embodiment, the dispensing device from which the bag would be picked-up is selected depending on the detected product dimensions; a change in at least one of the product dimensions would imply a change of the bag dispensing device to be selected.

In a second embodiment of the apparatus of the present invention, at least one bag dispensing device of said plurality of bag dispensing devices is adapted to dispense bags having a predetermined width which is different with respect to the width of the bags dispensed by the other bag dispensing devices and comprises:

a packaging film roll including a flattened tubing of packaging film adapted to form a plurality of bags having substantially all the same width;

means for advancing said packaging film, along a predetermined first direction, of a predetermined distance depending on the detected product dimensions;

means for sealing each other said packaging film along a second direction transverse to said predetermined first direction, at said predetermined distance;

means for severing the sealed packaging film so as to form a bag ready to be picked-up. Advantageously, according to this embodiment, the bag is formed after the detection of the product dimensions. In particular, once the bag dispensing device has been selected (depending on the detected product width) a plurality of bags having different length can be formed. Therefore, a change in the product length (but not in the product width) would not imply a change of the bag dispensing device to be selected, thus increasing the flexibility of the apparatus.

The means for detecting the dimensions of each product to be packaged are adjacent to the conveyor and are located between the product loading portion and the product packaging bracket end portion of the conveyor, in close proximity of said product loading portion. According to a first embodiment of the apparatus of the present invention, said means comprises a plurality of photocells suitably positioned around the conveyor in order to detect the three dimensions (height, length and width) of the products to be packaged.

In a different embodiment of the apparatus of the present invention, said means comprises an artificial vision system, such as, for example, one or more telecameras. Advantageously, by using a telecamera, a product quality check can also be carried out during the packaging process.

Preferably, each one of said plurality of bag dispensing devices comprises means for opening the bag to be picked-up. More preferably, said means for opening the bag to be picked-up comprises first means for blowing an air flow toward an unsealed side of the bag in order to at least partially open a bag mouth defined therein. In an alternative embodiment of the apparatus of the present invention, said means for opening the bag to be picked-up comprises suction means able to cooperate with an unsealed side of the bag in order to at least partially open a bag mouth defined therein.

Preferably, said means for selecting a bag dispensing device from said plurality of bag dispensing devices comprises a machine control system.

Preferably, said means for picking-up the bag from the selected bag dispensing device comprises at least one motorized mechanical arm or robot. Advantageously, as robot capabilities of movement are extremely good and the handled bag is very light, it is possible to quickly and safely transfer the picked-up bag from the bag dispensing device to the product packaging bracket end portion of the conveyor belt, thus allowing to increase the packaging speed and, consequently, the production yield of the apparatus. More advantageously, as all the complex and difficult movements for packaging the products into the bag are carried out by the mechanical arm handling the bag, it is possible to drastically simplify the structural design of the conveyor handling the products (or the structural equipment intended for driving the conveyor in operation), which can therefore be constructively simple and be moved at a substantially regular speed (for example, a constant speed).

Moreover, picking up of the bags by a mechanical arm or robot makes also possible to maintain the bags far away from foodstuff to be packaged in order to avoid bag contamination and subsequent risks of seal rejects due to the presence of blood, purge or fat between bag webs to be subsequently sealed.

Preferably, said at least one motorized mechanical arm comprises an end member provided with a plurality of fingers adapted to be inserted inside the open mouth of the bag to be picked-up for completely opening, picking-up and transferring said bag in proximity of said product packaging bracket end portion of said at least one conveyor. Advantageously, the picking up and the movement of the bag is carried out by very simple structural means.

More advantageously, said plurality of fingers are mounted on the end member of said motorized mechanical arm at different height and width thereof, for allowing to completely open bags of different size and give to the bag mouth a desired shape (width×height). This is possible by inserting into the bag mouth just some or all of the fingers, depending on the size of the bag to be opened.

Preferably, said at least one motorized mechanical arm is operatively associated to at least one pneumatic cylinder capable of commanding the operation (widening/closing) of said plurality of fingers.

Preferably, said end member comprises second means for blowing an air flow inside the bag when it has been picked-up, in order to keep it completely open and rigid during the movement from the bag dispensing device to the product packaging bracket end portion of the conveyor.

Preferably, the apparatus of the present invention further comprises means for synchronizing said at least one conveyor and said at least one motorized mechanical arm so that when the product to be packaged reaches a free end of said product packaging bracket end portion of said at least one conveyor, the bag which has been picked-up entirely surrounds both the product to be packaged and the product packaging bracket end portion of said at least one conveyor. Advantageously, while the product moves toward the free end of said product packaging bracket end portion of the conveyor, the bag moves from the bag dispensing device toward said free end and, afterwards, horizontally toward the product so that both the product to be packaged and the bracket end portion of the conveyor be fitted into the selected bag.

Preferably, the apparatus of the invention further comprises means for delivering the packaged product from said product packaging bracket end portion of the conveyor to following processing steps, such as vacuumization, sealing or clipping, heating and shrinking steps. In the preferred embodiment of the apparatus of the present invention, said means for delivering the packaged product from said product packaging bracket end portion of the conveyor belt comprises a conveyor placed below the free end of said product packaging bracket end portion and intended to collect thereon the packaged product.

In a preferred embodiment of the present invention, said plurality of bags is of a heat-shrinkable type and the product to be packaged is a food product.

As the product packaging end portion of the conveyor is adapted to be inserted into the bag along with the product to be packaged, the width of such packaging end portion should be smaller than the width of the bag, which itself would be different depending on the dimensions of the product to be packaged. It is therefore desirable that the width of the conveyor be adjustable depending on the width of the product to be packaged. On the other side, particularly for the packaging of fresh meat (which is flexible), it would be desirable to ensure that the product be supported by the conveyor for all its width. With this regard, preferably, said at least one conveyor comprises at least one first longitudinal side portion pivotably movable with respect to an axis perpendicular to a feeding direction of the products on the conveyor in order to be rotated from a first position, wherein said at least one first longitudinal side portion is substantially coplanar to the remaining portion of said at least one conveyor, to a second position wherein said at least one first longitudinal side portion lies on a different plane with respect to the remaining portion of said at least one conveyor.

In a second aspect thereof, the present invention relates to a method for packaging products, comprising the steps of:

loading in sequence a plurality of products to be packaged on a product loading portion of at least one conveyor;

carrying said plurality of products from said product loading portion to a product packaging bracket end portion of said at least one conveyor;

detecting the dimensions of each product to be packaged while it moves from said product loading portion to said product packaging bracket end portion of said at least one conveyor;

providing a plurality of bag dispensing devices for dispensing a plurality of bags varying in at least one dimension thereof;

selecting a bag dispensing device from said plurality of bag dispensing devices, depending on the detected product dimensions;

picking-up a bag from the selected bag dispensing device and positioning it around the product packaging bracket end portion of said at least one conveyor thus packaging the product present thereon.

Such a method allows to achieve all the advantages above mentioned with respect to the apparatus of the present invention.

In a first embodiment thereof, the method of the present invention comprises the step of placing a bag of said plurality of bags at a pick-up position.

In a different embodiment thereof, the method of the present invention further comprises the steps of forming in line a bag to be picked-up from a flattened tubing of packaging film wound onto a core housed in the selected bag dispensing device, wherein the dimensions of the formed bag depend on the detected product dimensions.

Preferably, the method of the present invention further comprises the step of opening the bag to be picked-up.

Preferably, the method of the present invention further comprises the step of synchronizing the movement of said at least one conveyor and said bag so that when the product to be packaged reaches a free end of said product packaging bracket end portion of said at least one conveyor, the bag entirely surrounds both the product to be packaged and the product packaging bracket end portion of said at least one conveyor.

Preferably, the method of the present invention further comprises the step of delivering the packaged product from said product packaging bracket end portion of the conveyor to following processing steps.

BRIEF DESCRIPTION OF THE DRAWINGS

These and further features and advantages of the present invention will be more clearly apparent from the following detailed description of a preferred embodiments of the invention, made with reference to the enclosed drawings, in which.

DETAILED DESCRIPTION OF PREFERRED EMBODIMENTS OF THE INVENTION

Figure 1:
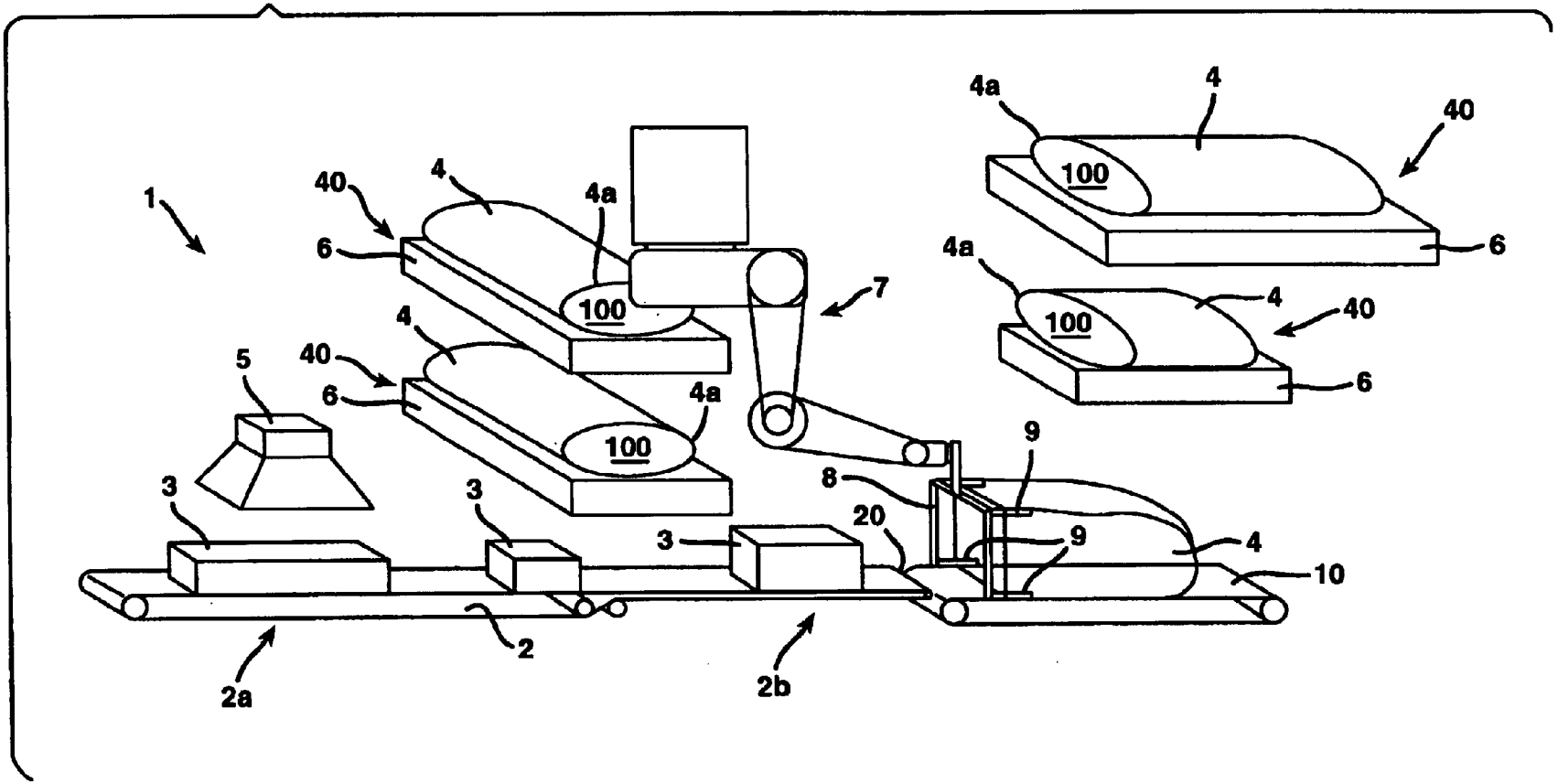
FIG. 1 is a perspective view of an apparatus according the present invention, represented in a schematic manner.

In the drawings, reference 1 indicates an apparatus for packaging products according to the present invention. In particular, the apparatus 1 is suitable to package products with different shape and dimensions into pre-formed bags of appropriate size; the packaged product is afterwards delivered to following processes, such as vacuumization, sealing or clipping, heating and shrinking processes.

Apparatus 1 comprises a conveyor 2, for example a conveyor belt, for carrying on a plurality of products (all indicated with reference 3) to be packaged into pre-formed bags (all indicate with reference 4).

For the sake of clarity and conciseness, in the following description, explicit reference will be made to food product and to thermoplastic heat-shrinkable pre-formed bags. However, one skilled in the art will appreciate that also other kind of products and pre-formed bags can be used in conjunction to the apparatus 1, without departing from the scope of the present invention.

The conveyor belt 2 comprises opposite end portions, namely a product loading end portion 2*a* and a product packaging, bracket end portion 2*b*, the latter, being very thin. In close proximity of said product loading end portion 2*a* and between said product loading end portion 2*a* and said product packaging bracket end portion 2*b*, means 5 for detecting the dimensions of the products 3 to be packaged while they move from said product loading portion 2*a* to said product packaging bracket end portion 2*b* of said conveyor belt 2 are provided.

In the preferred embodiment of the apparatus 1, said means 5 for detecting the dimensions of each product 3 to be packaged comprises a plurality of photocells located adjacently to the conveyor belt 2 in order to detect the three dimensions (height, length and width) of the products 3 to be packaged. However, other types of detecting means can also be used as, for example, artificial vision systems, such as one or more telecameras.

The apparatus 1 further comprises a plurality of bag dispensing devices (all indicated with reference 6) not completely illustrated in the attached drawings. Each bag dispensing device 6 is intended for housing a bags box containing a plurality of bags 4 which are substantially identical each others, i.e. having substantially the same size. Each bag of each bags box is associated to another bag of the same bags box in a conventional manner, i.e., for example, by two adhesive tapes. The bags 4 housed within each dispensing device 6 are of different size with respect to the ones housed within the other dispensing devices 6.

Each dispensing device 6 further comprises a motorized cylinder for selectively taking a bag of said plurality of bags and placing it at a respective pick-up position (indicated with reference 40 in the drawings) by pulling the adhesive means wound on it.

In operation, the apparatus 1 provides, for each product 3 to be packaged, a plurality of bags 4 of different size ready to be picked-up, each one for each bag dispensing device 6. When one of these bags 4 is picked up for packaging the product 3, the above mentioned motorized cylinder brings a next bag to said pick-up position.

In the pick-up position 40, the bags 4 are opened by blowing means, not illustrated, provided on each bag dispensing device 6. In particular, said blowing means are adapted to blow an air flow toward an unsealed side 4*a* of the bag 4 in order to at least partially open a bag mouth 100 defined therein. In an alternative embodiment of the apparatus 1 of the present invention, also not illustrated, said blowing means are replaced by suction means able to cooperate with said unsealed side 4*a* of the bag 4 in order to at least partially open said bag mouth 100.

The apparatus 1 further comprises means (not illustrated) for selecting a bag 4 from said plurality of bags ready to be picked-up, depending on the detected product dimensions. Such selecting means, in particular a machine control system, are operatively associated to the detecting means 5 and to a motorized mechanical arm 7 or robot adapted to pick-up the selected bag 4 and position it around the product packaging bracket end portion 2*b* of the conveyor belt 2, thus packaging the product 3 present thereon.

The motorized mechanical arm 7 comprises an end member 8 provided with a plurality of (for example, four) widening fingers 9 adapted to be inserted inside the open mouth 100 of the selected bag 4 for completely opening, picking-up and transferring said selected bag 4 to the product packaging bracket end portion 2*b* of the conveyor belt 2, while keeping the bag mouth 100 open. A pneumatic cylinder, not illustrated, is provided for commanding the widening and closing of said plurality of fingers 9 in order to pick up and release the selected bag, respectively. The pneumatic cylinder opens the bag widening the fingers along a predetermined direction up to the maximum opening of the latter. Alternatively, two pneumatic cylinders can be, provided for opening the bag along different directions.

The fingers 9 are mounted on the end member 8 at different height and width thereof, thus allowing to completely open bags 4 of different size by inserting thereinside some or all of the fingers 9 and/or giving a desired shape (width×height) to the bag mouth 100.

Second means for blowing an air flow inside the selected bag when it has been picked-up could be provided on the end member 8 of the motorized mechanical arm 7 in order to keep the selected bag completely open, and rigid during the movement from the bag dispensing device 6 to the product packaging bracket end portion 2*b* of the conveyor belt 2.

Figure 5:
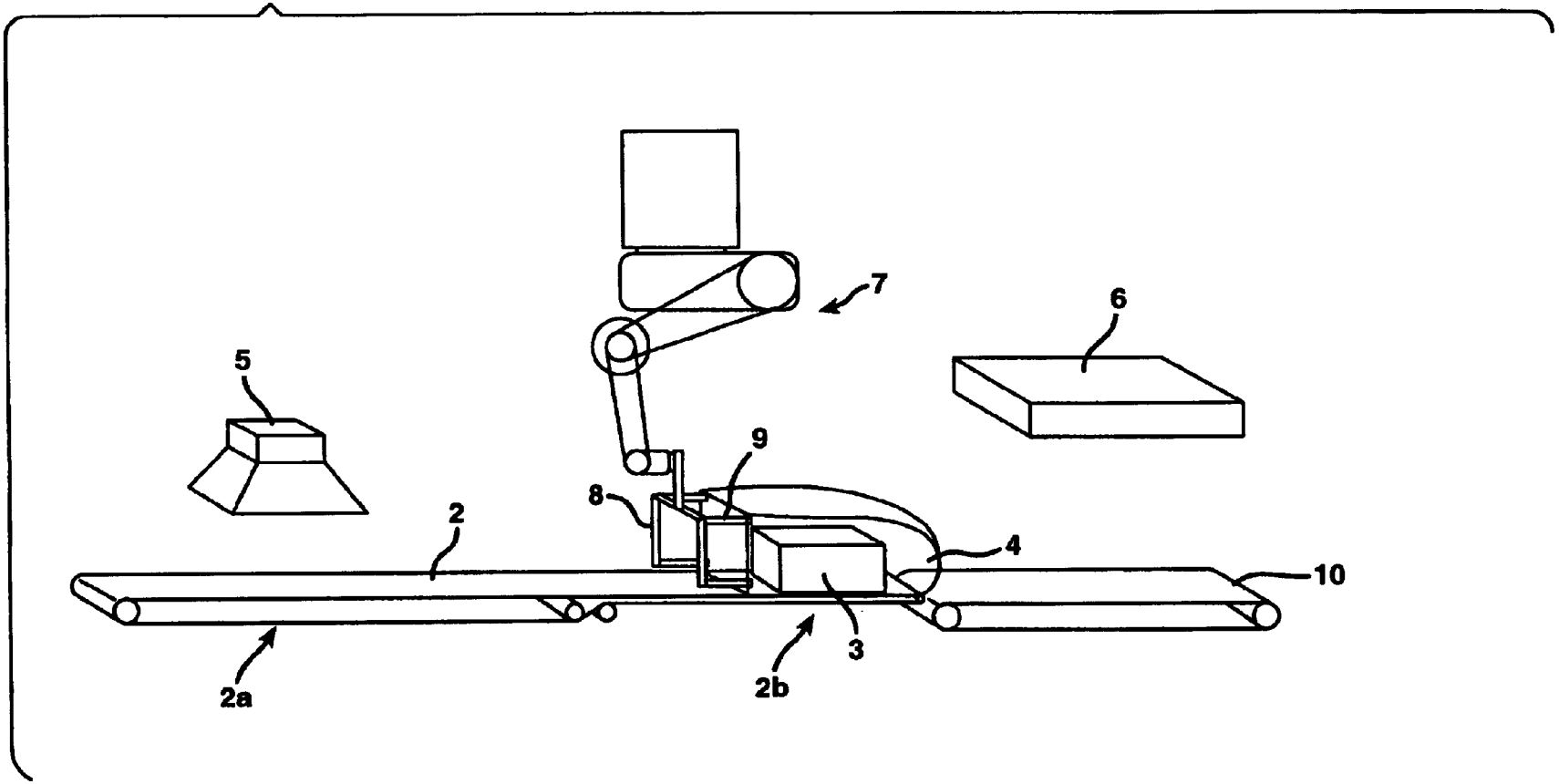
FIG. 5 is a partial schematic perspective view of the apparatus of FIG. 1, in a fourth operative condition.

The apparatus 1 further comprises means for synchronizing the movement of the conveyor belt 2 and of the motorized mechanical arm 7 so that when the product 3 to be packaged reaches a free end 20 of the product packaging bracket end portion 2*b* of the conveyor belt 2, the selected bag 4 entirely surrounds both the product 2 to be packaged and the product packaging bracket end portion 2*b* of the conveyor belt 2 (see FIG. 5). In particular, while the product 3 moves toward the free end 20 of the product packaging bracket end portion 2*b* of the conveyor belt 2, the selected bag 4 moves from the bag dispensing device 6 toward said free end 20 and, afterwards, horizontally toward the products 3 so that both the products 3 to be packaged and the bracket end portion 2*b* of the conveyor belt 2 are fitted into the selected bag 4. Alternatively, the movement of the selected bag 4 from the bag dispensing device 6 to the free end 20 of the conveyor belt 2 can be carried out while the product 3 is stopped at the free end 20 of the conveyor belt 2.

The apparatus 1 of the invention further comprises a second conveyor belt 10 placed below the free end 20 of the product packaging bracket end portion 2*b* of the conveyor belt 2 for collecting thereon the packaged product and delivering it to following processing steps, such as vacuumization, sealing or clipping, heating and shrinking steps.

In a preferred embodiment, not illustrated, of the apparatus 1 of the invention, the width of the conveyor belt 2 can be adjustable depending on the width of the product 3 to be packaged. In this embodiment, the conveyor belt 2 comprises one or more first longitudinal side portion pivotably movable with respect to an axis perpendicular to a feeding direction of the products on the conveyor belt 2 in order to be rotated from a first position, wherein said longitudinal side portion is substantially coplanar to the remaining portion of the conveyor belt, to a second position wherein said longitudinal side portion lies on a different plane with respect to the remaining portion of said at least one conveyor belt.

Figure 2:
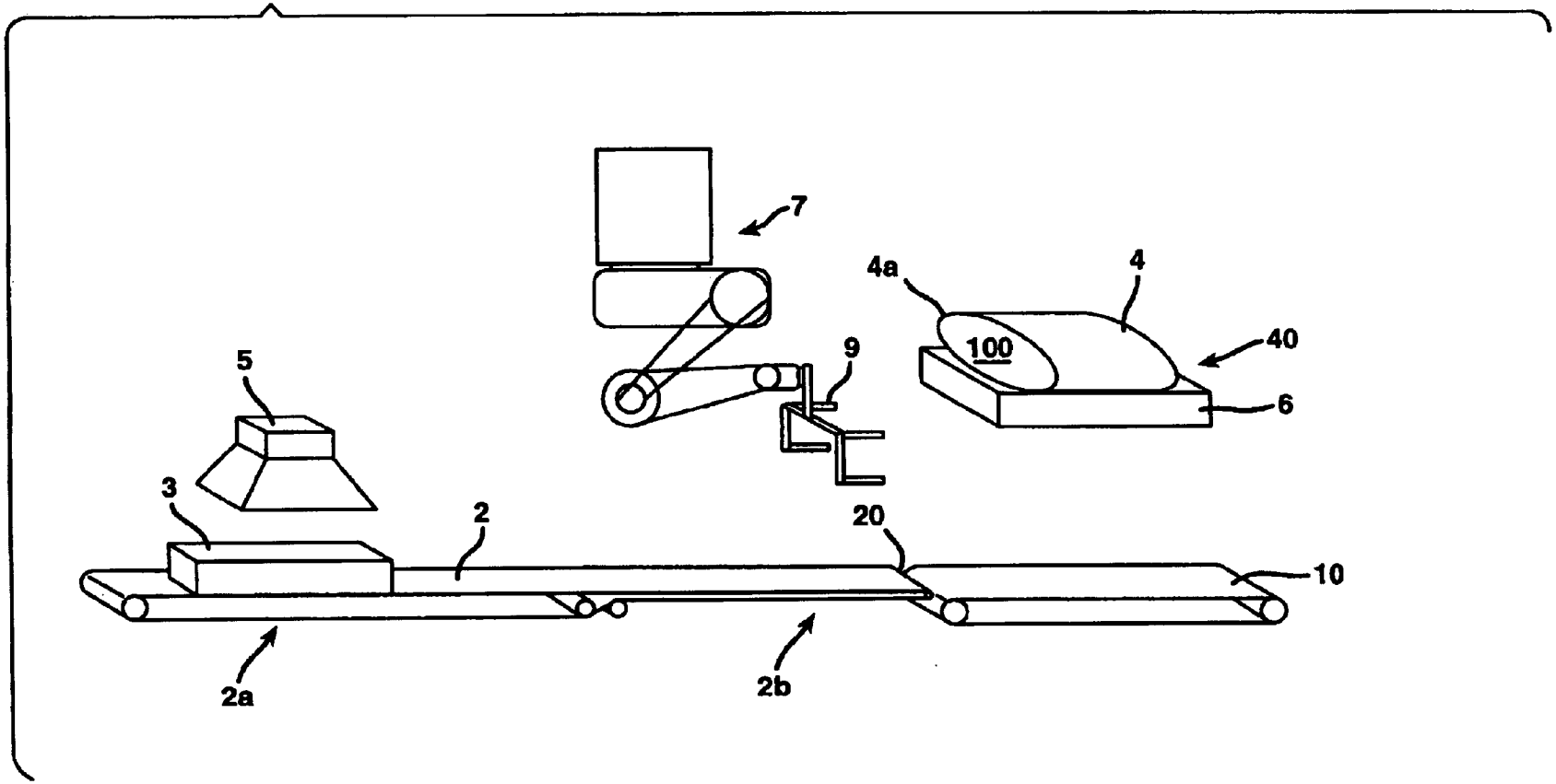
FIG. 2 is a partial perspective view of the apparatus of FIG. 1, in a first operative condition.
Figure 3:
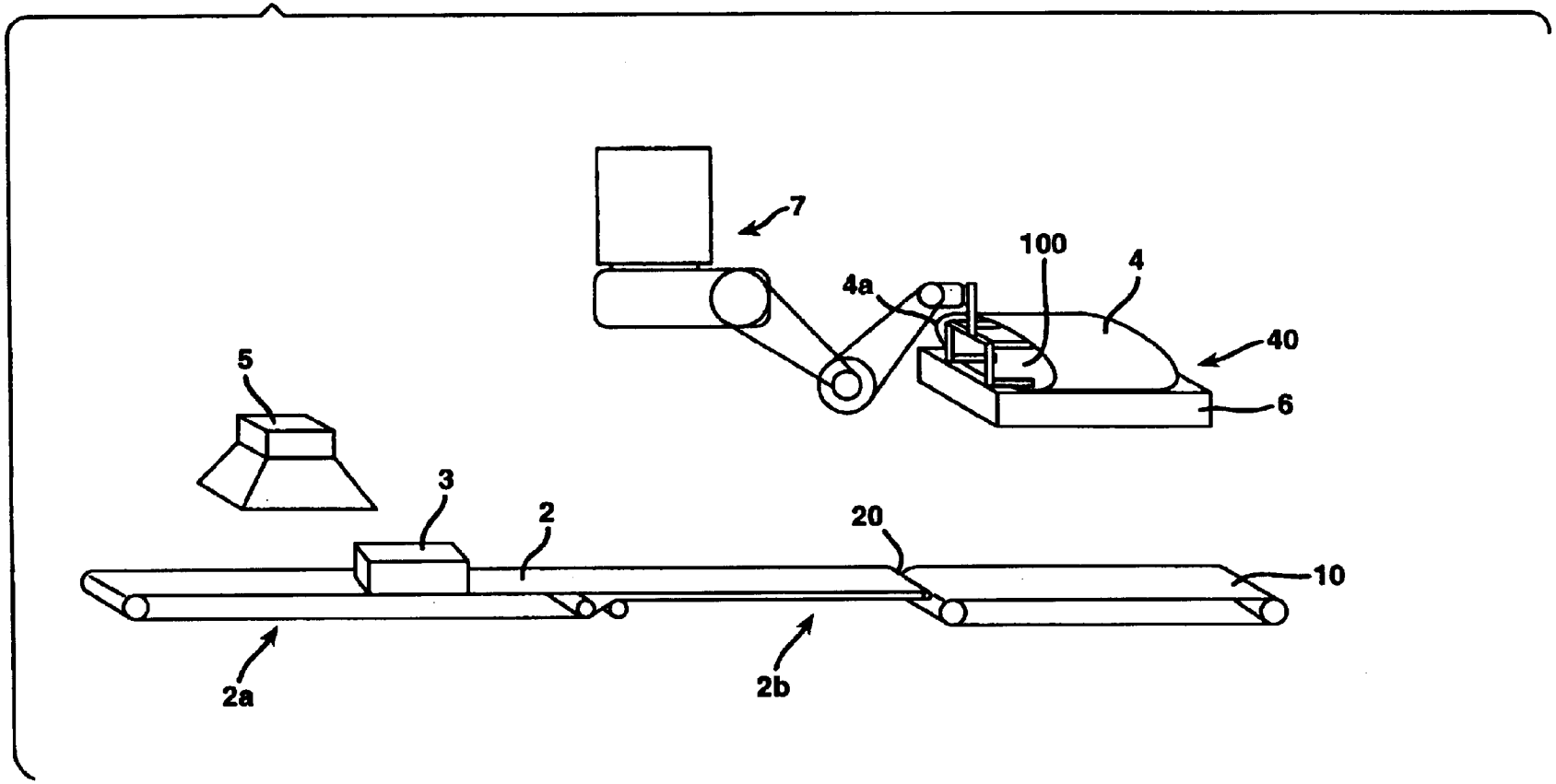
FIG. 3 is a partial schematic perspective view of the apparatus of FIG. 1, in a second operative condition.

In operation, a plurality of products 3 to be packaged, having different dimension and shape, are loaded in sequence on the product loading portion 2*a* of the conveyor belt 2 (manually by the operator(s) or coming from another conveyor belt of the production line) (see FIG. 2). The conveyor belt 2 carries said plurality of products 3 from said product loading portion 2*a* to the product packaging bracket end portion 2*b* thereof. During this movement, the detecting means 5 detects the dimensions of each product and supplies the information to the machine control system which selects, among the plurality of bags 4 of different size ready to be picked-up available at the respective bag dispensing device 6, the one having appropriate size (i.e. the one having dimensions a little bit-larger than those of the product 3), depending on the detected product dimensions (see FIG. 3).

Figure 4:
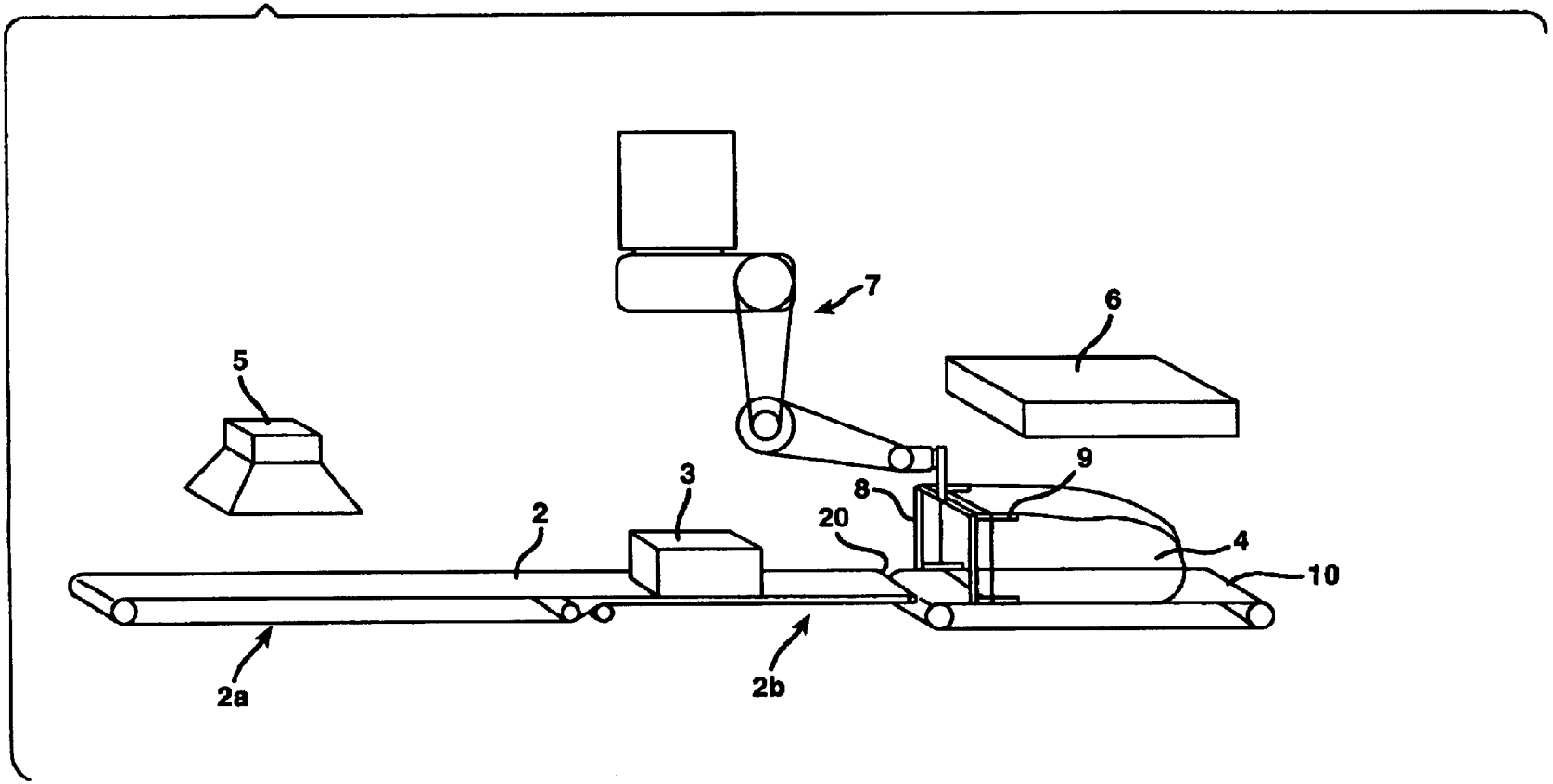
FIG. 4 is a partial schematic perspective view of the apparatus of FIG. 1, in a third operative condition.

The motorized mechanical arm 7 picks the selected bag 4 up from its open mouth 100 by widening thereinside the fingers 9 and transfers it adjacent to the free end 20 of the conveyor belt 2 always keeping the bag mouth 100 open (see FIG. 4). If needed, an air flow can be blown inside the selected bag 4 in order to keep it open and rigid during this movement.

Therefore, while the product 3 moves toward the free end 20 of the product packaging bracket end portion 2*b* of the conveyor belt 2, the selected bag 4 moves from the bag dispensing device 6 toward said free end 20 and, afterwards, horizontally toward the products 3 so that when the product 3 to be packaged reaches the free end 20 of the product packaging bracket end portion 2*b* of the conveyor belt 2, the selected bag 4 entirely surrounds both the product 3 to be packaged and the product packaging bracket end portion 2*b* of the conveyor belt 2, thus packaging the product 3 present thereon (see FIG. 5).

Figure 6:
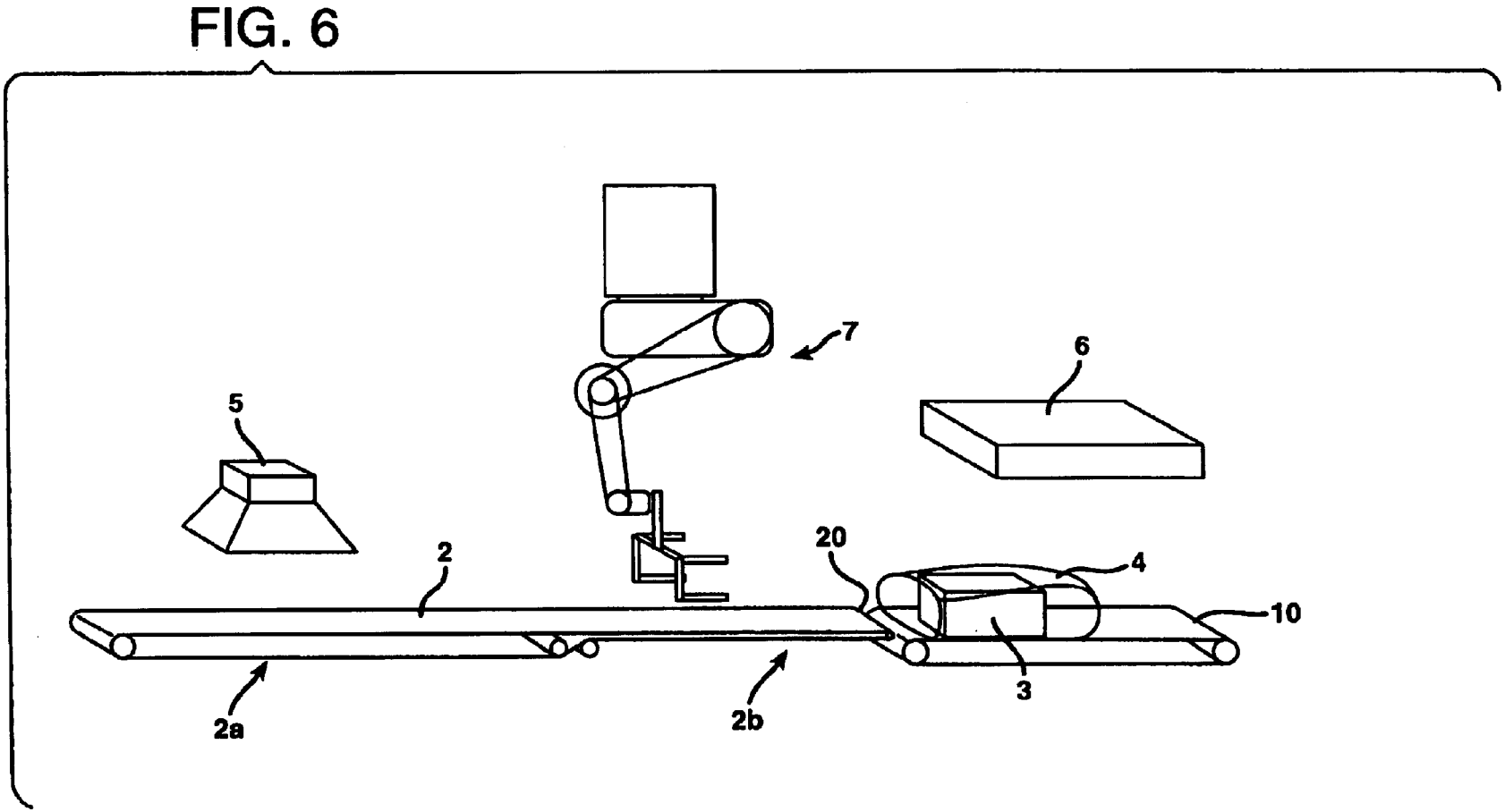
FIG. 6 is a partial schematic perspective view of the apparatus of FIG. 1, in a fifth operative condition.

The mechanical arm 7 releases the bag 4 with the product thereinside by closing the fingers 9; the packaged product 3 continues to move on the conveyor belt 2 and is transferred to the second conveyor belt 10 in order to be delivered to following processes (see FIG. 6).

Figure 7:
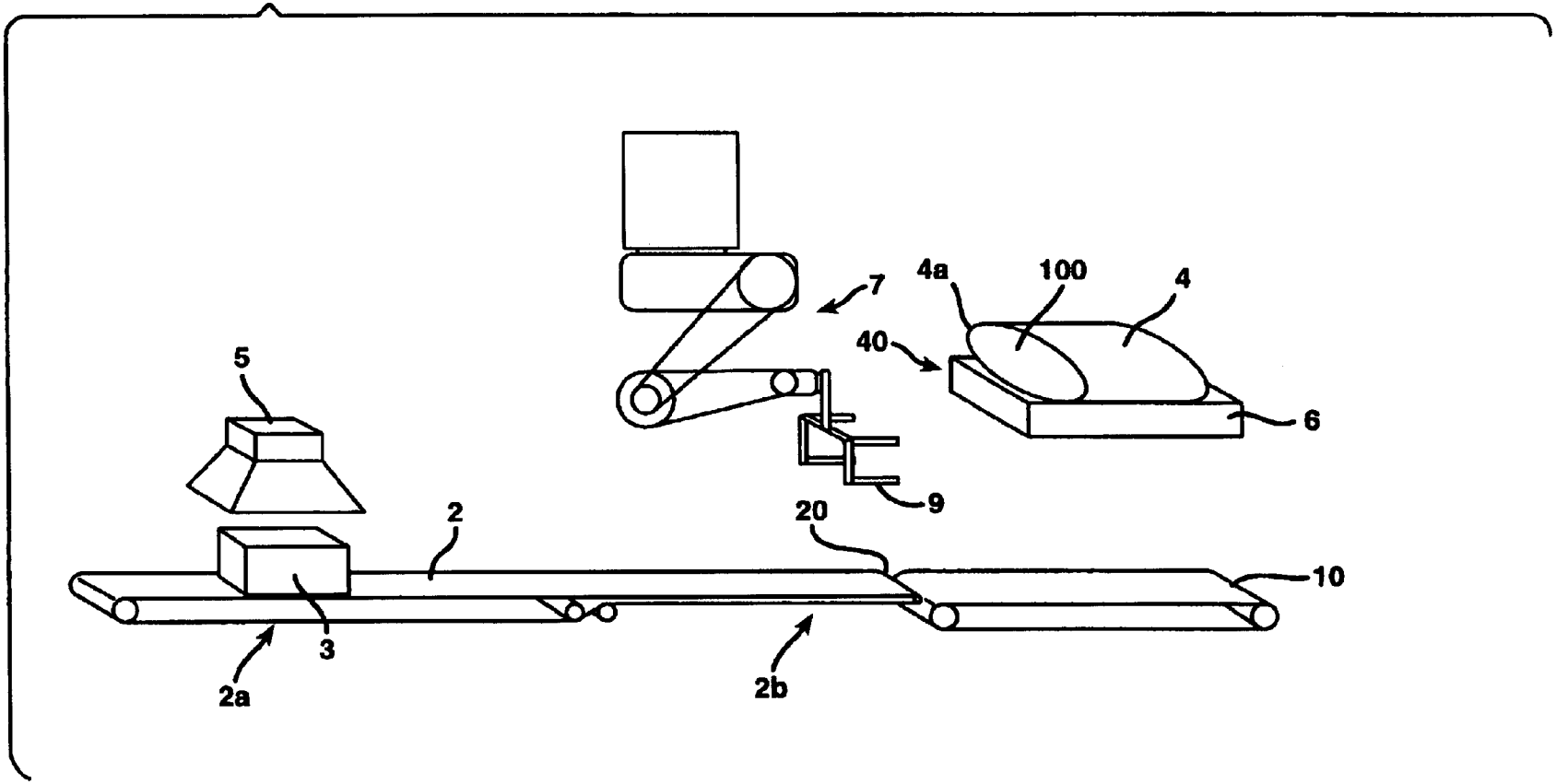
FIG. 7 is a partial schematic perspective view of the apparatus of FIG. 1, in a sixth operative condition coinciding to the first one.

The apparatus 1 is now ready for packaging another product (see FIGS. 7 and 1).

It will be assumed that numerous changes and modifications can be made to the embodiment described herein without departing from the spirit and scope of the invention.

For example, embodiments comprising two mechanical arms 7 in conjunction with a single conveyor belt 2 or two conveyor belts 2 in conjunction with a single mechanical arm 7 could be provided, in order to increase the apparatus's productivity.

Moreover, different embodiments of bag dispensing devices may be implemented in the apparatus 1 of the present invention, in alternative of or in conjunction to the embodiment above described. In particular, the bags 4 housed within the bags box may be not associated each other, but just superimposed (without any adhesive tapes therebetween). Of course, in such embodiment of the apparatus 1, the mechanical arm 7 would be capable of picking up the upper bag 4 from the bags box housed within the dispensing device 6 (for example, by means of suction caps provided thereon) and open the bag while moving it toward the free end 20 of the product packaging bracket end portion 2*b* of the, conveyor belt 2 (or by means of other suction caps provided on the apparatus 1).

Furthermore, in place of using the above described bags boxes or in conjunction with them, each bag dispensing device 6 may house a bag precursor (i.e. a core having a flattened tubing of packaging film wound thereon) adapted to dispense bags 4 having all a predetermined width and possibly different length. Such bags 4 have however a width which is different with respect to the width of the bags 4 dispensed from the other bag dispensing devices 6. In operation, a bag dispensing device 6 is selected depending on the detected product dimensions. Once selected, the flattened tubing is rotated and the packaging film is unwound of a predetermined distance depending on the detected product length. This can be carried out by means of the mechanical arm 7, which picks the mouth of the flattened tubing and pulls it back along a predetermined first direction, or by means of two counter-rotating feed rollers having the mouth of the flattened tubing placed therebetween, or by means of appropriate motor means which drive in rotation the flattened tubing core. Conventional means are provided for sealing, at said predetermined distance, the packaging film along a second direction transverse to said predetermined first direction and for severing the sealed packaging film so as to form in line a bag ready to be picked-up.

What is claimed is:

1. Apparatus for packaging products, comprising:

at least one conveyor for carrying in sequence a plurality of products to be packaged from a product loading portion to a product packaging bracket end portion thereof;

means for detecting the dimensions of each product to be packaged while the product moves from said product loading portion to said product packaging bracket end portion of said at least one conveyor;

a plurality of bag dispensing devices for dispensing a plurality of bags varying in at least one dimension thereof;

means for automatically selecting a bag dispensing device from said plurality of bag dispensing devices, depending on the detected product dimensions; and means for mechanically picking-up a bag from the selected bag dispensing device and positioning the bag around the product packaging bracket end portion of said at least one conveyor thus packaging the product present thereon.

2. Apparatus according to claim 1, wherein said plurality of bag dispensing devices are adapted to provide, for each product to be packaged, a plurality of bags of different size, and wherein each bag dispensing device of said plurality of bag dispensing devices comprises a plurality of bags having substantially all the same size and means for placing a bag of said plurality of bags at a pick-up position.

3. Apparatus according to claim 1 wherein at least one bag dispensing device of said plurality of bag dispensing devices is adapted to dispense bags having a predetermined width which is different with respect to the width of the bags dispensed by the other bag dispensing devices and comprises:

a packaging film roll including a flattened tubing of packaging film adapted to form a plurality of bags having substantially all the same width;

means for advancing said packaging film, along a predetermined first direction, of a predetermined distance depending on the detected product dimensions;

means for sealing said packaging film along a second direction transverse to said predetermined first direction at said predetermined distance;

means for severing the sealed packaging film so as to form a bag ready to be picked-up.

4. Apparatus according to claim 1 wherein said means for detecting the dimensions of each product to be packaged comprises a plurality of photocells.

5. Apparatus according to claim 1 wherein said means for detecting the dimensions of each product to be packaged comprises an artificial vision system.

6. Apparatus according to claim 1 wherein each one of said plurality of bag dispensing devices comprises means for opening the bag to be picked-up.

7. Apparatus according to claim 6, wherein said means for opening the bag to be picked-up comprises first means for blowing an air flow toward an unsealed side of the bag in order to at least partially open a bag mouth defined therein.

8. Apparatus according to claim 6, wherein said means for opening the bag to be picked-up comprises suction means able to cooperate with an unsealed side of the bag in order to at least partially open a bag mouth.

9. Apparatus according to claim 1 wherein said means for automatically selecting a bag dispensing device from said plurality of bag dispensing devices comprises a machine control system.

10. Apparatus according to claim 1 wherein said means for mechanically picking-up the bag from the selected bag dispensing device comprises at least one motorized mechanical arm.

11. Apparatus according to claim 10 wherein:

each one of said plurality of bag dispensing devices comprises means for opening the bag to be picked-up selected from: i) means for blowing an air flow toward an unsealed side of the bag in order to at least partially open a bag mouth defined therein and ii) suction means able to cooperate with an unsealed side of the bag in order to at least partially open a bag mouth; and said at least one motorized mechanical arm comprises an end member provided with a plurality of fingers adapted to be inserted inside the open mouth of the bag to be picked-up for completely opening, picking-up and transferring said bag in proximity of a free end of said product packaging bracket end portion of said at least one conveyor.

12. Apparatus according to claim 11 wherein said at least one motorized mechanical arm is operatively associated to at least one pneumatic cylinder capable of commanding the operation of said plurality of fingers.

13. Apparatus according to claim 12 further comprising means for synchronizing said at least one conveyor and said at least one motorized mechanical arm so that when the product to be packaged reaches a free end of said product packaging bracket end portion of said at least one conveyor, the bag which has been picked-up entirely surrounds both the product to be packaged and the product packaging bracket end portion of said at least one conveyor.

14. Apparatus according to claim 10 wherein said motorized mechanical arm comprises second means for blowing an air flow inside the bag when the bag has been picked-up.

15. Apparatus according to claim 1 further comprising a second conveyor adapted for delivering the packaged product from said product packaging bracket end portion of the at least one conveyor.

16. Apparatus according to claim 1 wherein said plurality of bags is of a heat-shrinkable type and the product to be packaged is a food product.

17. Apparatus according to claim 1 wherein said at least one conveyor comprises at least one first longitudinal side portion pivotably movable with respect to an axis perpendicular to a feeding direction of the products on the conveyor in order to be rotated from a first position, wherein said at least one first longitudinal side portion is substantially coplanar to the remaining portion of said at least one conveyor, to a second position wherein said at least one first longitudinal side portion lies on a different plane with respect to the remaining portion of said at least one conveyor.

18. The apparatus according to claim 1 wherein the means for detecting the dimensions is adapted to detect the length, height, and width of the product to be packaged.

19. Method for packaging products, comprising the steps of:

loading in sequence a plurality of products to be packaged on a product loading portion of at least one conveyor;

carrying said plurality of products from said product loading portion to a product packaging bracket end portion of said at least one conveyor;

detecting the dimensions of each of the plurality of products to be packaged while each of the plurality of products moves from said product loading portion to said product packaging bracket end portion of said at least one conveyor;

providing a plurality of bag dispensing devices for dispensing a plurality of bags varying in at least one dimension thereof;

automatically selecting a bag dispensing device from said plurality of bag dispensing devices, depending on the detected product dimensions; and mechanically picking-up a bag from the selected bag dispensing device and positioning the bag around the product packaging bracket end portion of said at least one conveyor thus packaging the product present thereon.

20. Method according to claim 19 further comprising the step of placing a bag of said plurality of bags at a pick-up position.

21. Method according to claim 19, further comprising the steps of forming in line a bag ready to be picked-up from a flattened tubing of packaging film wound onto a core housed in the selected bag dispensing device, wherein the dimension of the formed bag depend on the detected product dimensions.

22. Method according to claim 21 further comprising the step of synchronizing the movement of said at least one conveyor and said bag so that when the product to be packaged reaches a free end of said product packaging bracket end portion of said at least one conveyor, the bag entirely surrounds both the product to be packaged and the product packaging bracket end portion of said at least one conveyor.

23. Method according to claim 21 further comprising the step of delivering the packaged product from said product packaging bracket end portion of the conveyor to one or more following processing steps selected from vacuumization, sealing, clipping, heating, and shrinking.

24. Method according to claim 19 further comprising the step of opening the bag to be picked-up.

25. The method according to claim 19 wherein a machine control system:

1) receives information regarding the dimensions of each of the plurality of products from the detection step;

2) performs the automatic selecting step utilizing said information; and 3) controls the mechanical picking-up step.

26. The method according to claim 19 wherein the detecting step detects the length, height, and width of each of the plurality of products to be packaged.

27. The method according to claim 19 wherein the detecting step utilizes a plurality of photocells.

28. The method according to claim 19 wherein the detecting step utilizes an artificial vision system.

29. The method according to claim 19 wherein the mechanical picking-up step utilizes a motorized mechanical arm.

* * * * *